US007786059B2

(12) United States Patent
Buitrago

(10) Patent No.: US 7,786,059 B2
(45) Date of Patent: Aug. 31, 2010

(54) ANTI-WEAR ADDITIVE COMPOSITION AND LUBRICATING OIL COMPOSITION CONTAINING THE SAME

(75) Inventor: Juan Alberto Buitrago, Hercules, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 591 days.

(21) Appl. No.: 11/021,620

(22) Filed: Dec. 21, 2004

(65) Prior Publication Data

US 2006/0135379 A1 Jun. 22, 2006

(51) Int. Cl.
*C10M 137/04* (2006.01)
*C10M 169/04* (2006.01)

(52) U.S. Cl. ..... 508/434; 508/441

(58) Field of Classification Search ..... 508/441, 508/434

See application file for complete search history.

(56) References Cited

U.S. PATENT DOCUMENTS

| | | | | |
|---|---|---|---|---|
| 2,848,474 | A | 8/1958 | Marshall | |
| 3,053,341 | A | 9/1962 | Rounds | |
| 4,342,709 | A | 8/1982 | Jaffe | |
| 5,185,090 | A | 2/1993 | Ryer et al. | |
| 5,242,612 | A | 9/1993 | Ryer et al. | |
| 5,712,230 | A | 1/1998 | Abraham et al. | |
| 5,767,044 | A | 6/1998 | Bigelow et al. | |
| 5,792,733 | A | 8/1998 | Minami et al. | |
| 6,482,778 | B2 * | 11/2002 | Tersigni et al. | 508/188 |
| 2003/0171227 | A1 * | 9/2003 | Holt et al. | 508/438 |

FOREIGN PATENT DOCUMENTS

| | | |
|---|---|---|
| CA | 455494 | 3/1949 |
| EP | 0646639 A1 | 4/1995 |
| EP | 0677571 A1 | 10/1995 |
| EP | 1167496 A2 | 1/2002 |
| WO | WO 01/85878 A2 | 11/2001 |

* cited by examiner

*Primary Examiner*—Glenn Caldarola
*Assistant Examiner*—Jim Goloboy
(74) *Attorney, Agent, or Firm*—Josetta I. Jones

(57) ABSTRACT

An anti-wear additive composition comprising at least one acid phosphite compound and at least one neutral phosphite compound, wherein the ratio of the acid phosphite to the neutral phosphite is from about 1.0:10.7 to about 2.0:1.0, and lubricating oil compositions containing the same.

5 Claims, No Drawings

ANTI-WEAR ADDITIVE COMPOSITION AND LUBRICATING OIL COMPOSITION CONTAINING THE SAME

FIELD OF THE INVENTION

The present invention is directed to an improved anti-wear additive composition that may be used in lubricating oils, such as, but not limited to, manual transmission fluids, automatic transmission fluids, continuously variable transmission fluids, hydraulic pumps, engine oils and gear oils; and a process for preparing the same.

BACKGROUND OF THE INVENTION

Most base oils which are used as lubricating oils, such as engine oils or automatic transmission fluids, require the addition of additives to improve the performance of the lubricating oil and/or to reduce the friction and wear of the moving parts of a vehicle that rub together. These additives are generally classified as ones that influence the physical and chemical properties of the base fluids or affect primarily the metal surfaces by modifying their physicochemical properties. One such additive is an anti-wear agent that is used to reduce wear of metal components.

When General Motors Corporation (GM) upgraded its DEXRON®-III specification, several test procedures and limits were revised, including the wear limit. Previously the maximum weight loss accepted by GM was 15 mg. In the new specification, GM reduced this limit to 10 mg weight loss maximum. Not all anti-wear additive compositions provide suitable wear inhibition to meet the new GM specifications. Also some wear inhibitors may cause copper corrosion.

BACKGROUND ART

Rounds, U.S. Pat. No. 3,053,341, discloses a lubricant additive and a method of lubricating a hydraulically controlled automatic transmission and a hypoid gear type differential. The lubricant is a relatively low viscosity base material, which is suitable for operation in an automatic transmission, which is mixed with an additive, such as dialkyl phosphite. These types of materials have been used as anti-wear additives, but are corrosive towards copper and would not meet GM's specifications.

Minami et al., U.S. Pat. No. 5,792,733, discloses anti-wear lubricant additives that are used in a variety of lubricants that are based on diverse oils of lubricating viscosity, including natural and synthetic lubricating oils and mixtures thereof. The composition comprises an oil of lubricating viscosity, an anti-wear improving amount of at least one phosphorous compound, and a hydrocarbon of about 6 to about 30 carbon atoms having ethylenic unsaturation.

Jaffe, U.S. Pat. No. 4,342,709 discloses a process of producing diethyl phosphite. This process results in a high quality diethyl phosphite product having low acidity.

Ryer et al., U.S. Pat. No. 5,185,090 and U.S. Pat. No. 5,242,612 disclose an anti-wear additive comprising a mixture of products formed by simultaneously reacting (1) a betahydroxy thioether, such as thiobisethanol and (2) a phosphorous-containing reactant, such as tributyl phosphite.

SUMMARY OF THE INVENTION

Accordingly, in its broadest embodiment, the present invention is directed to an anti-wear additive composition comprising:

(a) at least one acid phosphite compound;
(b) at least one neutral phosphite compound; and
wherein the weight ratio of (a) to (b) is from about 1.0:10.7 to about 2.0:1.0.

The present invention is further directed to a lubricating oil composition comprising:
(a) at least one acid phosphite compound;
(b) at least one neutral phosphite compound; and
(c) a major amount of an oil of lubricating viscosity;
wherein the weight ratio of (a) to (b) is from about 1.0:10.7 to about 2.0:1.0.

The present invention is further directed to a method of making an anti-wear additive composition comprising:
mixing at least one neutral phosphite compound with at least one acid phosphite compound wherein the weight ratio of the acid phosphite compound to the neutral phosphite compound is from about 1.0:10.7 to about 2.0:1.0.

The present invention is further directed to a method of making a lubricating oil composition comprising:
sequentially or concurrently mixing an oil of lubricating viscosity with at least one neutral phosphite compound and
at least one acid phosphite compound wherein the weight ratio of the acid phosphite compound to the neutral phosphite compound is from about 1.00:10.7 to about 2.0:1.0.

The present invention is further directed to a method of reducing wear of metal components comprising lubricating contiguous metal components with a lubricating oil composition comprising:
(a) at least one acid phosphite compound;
(b) at least one neutral phosphite compound; and
(c) a major amount of an oil of lubricating viscosity;
wherein the weight ratio of (a) to (b) is from about 1.0:10.7 to about 2.0:1.0.

It is therefore an object of the invention to provide an improved anti-wear additive composition to be used in an oil of lubricating viscosity, which has the added advantage of low copper corrosion.

DETAILED DESCRIPTION OF THE INVENTION

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DEFINITIONS

The following terms used within the description are defined as such: The term "oil-soluble wear reducing phosphorous containing component(s)" refers to additives in lubricant compositions that contain phosphorous and which exhibit an anti-wear benefit, either alone or when used in combination with other additives that are present in lubricating oils, such as, but not limited to, manual transmission fluids, automatic transmission fluids, continuously variable transmission fluids, hydraulic pump fluids, engine oils and gear oils.

The term "total phosphorous" refers to the total amount of phosphorous in the lubricant composition regardless of whether such phosphorous is present as part of an oil-soluble wear reducing phosphorous containing component or in the form of a contaminant in the lubricant composition such as residual phosphorous. The amount of phosphorous in the lubricating oil composition is independent of source.

The term "DEXRON®-III" refers to a General Motors Corporation trademark for a specification for automatic transmission fluids primarily for use in GM automatic transmissions.

It has been discovered that the present anti-wear additive composition which is a combination of at least one neutral phosphite compound with at least one acid phosphite compound, has a synergistic effect and yields a surprising wear reducing property of metal surfaces in relative motion found in transmissions, engines, pumps, gears and other such metal comprising materials; furthermore, this novel, non-obvious anti-wear additive composition meets new wear requirements for automatic transmission fluids pursuing DEXRON®-III, H Revision, (hereinafter DEXRON®-III) approval.

The Additive Composition

The anti-wear additive composition of the present invention contains two oil-soluble additive components. This anti-wear additive composition may be used in lubricating oils, such as but not limited to, manual transmissions fluids, automatic transmission fluids, continuously variable transmission fluids, hydraulic pumps, engine oils and gear oils. The additive composition of the present invention comprises at least one neutral phosphite compound combined with at least one acid phosphite compound in a weight ratio that drastically reduces removal of metal of two mating surfaces in relative motion.

Included in the meaning of acid and neutral phosphite compounds are organic phosphite esters. The acid phosphite compounds may be selected from the group comprising hydrocarbyl phosphite compounds including but not limited to dihydrocarbyl hydrogen phosphite compounds. The neutral phosphite compounds may be selected from the group comprising hydrocarbyl phosphite compounds including but not limited to trihydrocarbyl phosphites.

An acid phosphite compound, such as dialkyl hydrogen phosphite, is represented by the following formula:

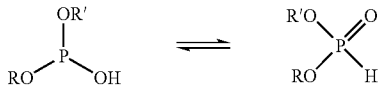

wherein R and R' are independently hydrocarbyl groups having from about 1 to about 24 carbon atoms, preferably from about 4 to about 18 carbon atoms, and more preferably from about 6 to about 16 carbon atoms. The R and R' groups may be saturated or unsaturated, aromatic, and straight or branched chain aliphatic hydrocarbyl radicals. Representative examples of suitable R and R' groups include methyl, ethyl, n-propyl, i-propyl, n-butyl, i-butyl, t-butyl, n-propenyl, n-butenyl, n-hexyl, nonylphenyl, n-dodecyl, n-dodecenyl, hexadecyl, octadecenyl, stearyl, iso-stearyl, hydroxystearyl, and the like. Preferably, R and R' are alkyl or aryl, most preferably alkyl.

Preferred acid phosphites include dihydrocarbyl hydrogen phosphites. More preferred dihydrocarbyl hydrogen phosphites include dialkyl hydrogen phosphites. Even more preferred dialkyl hydrogen phosphites include dilauryl hydrogen phosphite, which is manufactured and sold by Rhodia, Inc., Cranbury, N.J., and is marketed under the trade name Duraphos AP-230.

In addition to being purchased from Rhodia, Inc., dialkyl hydrogen phosphite may be also be synthesized from well known processes such as that disclose in U.S. Pat. No. 4,342,709, which is herein incorporated by reference.

A neutral phosphite compound, such as trialkyl phosphite, is represented by the following formula:

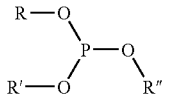

wherein R, R', and R" are independently hydrocarbyl groups having from about 1 to 24 carbon atoms, preferably from about 1 to about 24 carbon atoms, more preferably from about 4 to about 18 carbon atoms, and most preferably from about 6 to 16 carbon atoms. The R, R', and R" groups may be saturated or unsaturated, and straight or branched chain aliphatic hydrocarbyl radical. Representative examples of suitable R, R', and R" groups include methyl, ethyl, n-propyl, i-propyl, n-butyl, i-butyl, t-butyl, n-propenyl, n-butenyl, n-hexyl, nonylphenyl, n-dodecyl, n-dodecenyl, hexadecyl, octadecenyl, stearyl, i-stearyl, hydroxystearyl, and the like. Preferably, R, R' and R" are each alkyl or aryl.

Preferred neutral phosphite compounds include trihydrocarbyl phosphites. More preferred trihydrocarbyl phosphites include trialkyl phosphites. Most preferred trialkyl phosphites include trilauryl phosphite, which is manufactured and sold by Rhodia, Inc. and is marketed under the trade name Duraphos TLP.

In addition to being purchased from Rhodia, Inc., trialkyl phosphite may be synthesized from well known processes such as that described in U.S. Pat. No. 2,848,474 which is herein incorporated by reference.

The Lubricating Oil Composition

The wear reducing combination of at least one neutral phosphite compound and at least one acid phosphite compound is generally added to a base oil, such as an oil of lubricating viscosity, that is sufficient to lubricate and reduce the wear of metal surfaces and other components which are present in axles, transmissions, hydraulic pumps, engines and the like. Typically, the lubricating oil composition of the present invention comprises a major amount of an oil of lubricating viscosity and a minor amount of the anti-wear additive composition, which is comprised of at least one acid phosphite compound and at least one neutral phosphite compound.

Specifically, in addition to the oil of lubricating viscosity, the lubricating oil composition contains an additive composition having (a) at least one acid phosphite compound such as dihydrocarbyl hydrogen phosphite, such as dialkyl hydrogen phosphite, such as dilauryl hydrogen phosphite. The lubricating oil composition also contains (b) at least one neutral phosphite compound such as trihydrocarbyl phosphite, such as trialkyl phosphite, such as trilauryl phosphite, in the lubricating oil composition.

The preferred ratio of (a) to (b) in the lubricating oil composition is from about 1.0:10.7 to about 2.0:1.0. More preferred, the ratio of (a) to (b) in the lubricating oil composition is from about 1.0:10.1 to about 1.6:1.0. Even more preferred, the ratio of (a) to (b) in the lubricating oil composition is from about 1.0:9.9 to about 1.0:1.6. Most preferred, the ratio of (a) to (b) in the lubricating oil composition is from about 1.0:9.1 to about 1.0:3.0.

The lubricating oil composition comprises a total phosphorous weight percent from the combination of the at least one acid phosphite compound and the at least one neutral phosphite compound of from about 0.003% to about 0.300% of the lubricating oil composition. More preferred, the lubricating oil composition comprises a total phosphorous weight percent from the combination of the at least one acid phosphite compound and the at least one neutral phosphite compound of from about 0.006% to about 0.250% of lubricating oil composition. Most preferred, the lubricating oil composition comprises a total phosphorous weight percent from the combination of the at least one acid phosphite compound and the at least one neutral phosphite compound of from about 0.012% to about 0.100% of lubricating oil composition.

According to the Material Safety Data Sheet (MSDS), Duraphos TLP is comprised of approximately 90% trilauryl phosphite, 7.5% dialkyl hydrogen phosphite, 0.5% phenol and 2.0% impurities. The MSDS for Duraphos AP-230 discloses that this additive is comprised of approximately 92% dilauryl hydrogen phosphite and 8% impurities. Duraphos TLP has good antioxidant qualities and has a good effect on friction; however, when Duraphos TLP is used alone in a lubricating oil, it fails to meet the new GM wear specification. By contrast, Duraphos AP-230 (dilauryl hydrogen phosphite) is a known anti-wear agent, as taught in U.S. Pat. No. 3,053,341 which is incorporated herein by reference, but is also corrosive towards copper. It has been discovered that a certain ratio of at least one acid phosphite compound, such as dilauryl hydrogen phosphite, to at least one neutral phosphite compound, such as trilauryl phosphite has a synergistic effect on the reduction of wear, while this mixture is almost non-corrosive towards copper. The examples which follow (see Comparative Example E herein) show that a neutral phosphite compound, such as a trilauryl phosphite (e.g., Duraphos TLP), used alone as a wear inhibitor does not reduce wear enough to meet the new GM ATF wear specification. Surprisingly, however, when a synergistic amount of at least one neutral phosphite compound, such as Duraphos TLP, used in combination with at least one acid phosphite compound, such as Duraphos AP-230, wear is reduced. The synergistic effect of the two components is achieved when the weight ratio of the at least one acid phosphite compound, such as dilauryl hydrogen phosphite, to the at least one neutral phosphite compound, such as trilauryl phosphite is from about 1.0:10.7 to about 2.0:1.0. More preferred, the ratio of the at least one acid phosphite compound, such as dilauryl hydrogen phosphite, to the at least one neutral phosphite compound, such as trilauryl phosphite, is from about 1.0:10.1 to about 1.6:1.0. Even more preferred, the ratio of the at least one acid phosphite compound, such as dilauryl hydrogen phosphite, to the at least one neutral phosphite compound, such as trilauryl phosphite, is from about 1.0:9.9 to about 1.0:1.6. Most preferred, the ratio of the at least one acid phosphite compound, such as dilauryl hydrogen phosphite, to the at least one neutral phosphite compound, such as trilauryl phosphite, is from about 1.0:9.1 to about 1.0:3.0.

The base oil employed may be any one of a variety of oils of lubricating viscosity. The base oil of lubricating viscosity used in such compositions may be mineral oils or synthetic oils. A base oil having a viscosity of at least 2.5 cSt at 40° C. and a pour point below 20° C., preferably at or below 0° C., is desirable. The base oils may be derived from synthetic or natural sources. Mineral oils for use as the base oil in this invention include, but are not limited to, paraffinic, naphthenic and other oils that are ordinarily used in lubricating oil compositions. Synthetic oils include, but are not limited to, both hydrocarbon synthetic oils and synthetic esters and mixtures thereof having the desired viscosity. Hydrocarbon synthetic oils may include, but are not limited to, oils prepared from the polymerization of ethylene, polyalphaolefin or PAO oils, or oils prepared from hydrocarbon synthesis procedures using carbon monoxide and hydrogen gases such as in a Fisher-Tropsch process. Useful synthetic hydrocarbon oils include liquid polymers of alpha olefins having the proper viscosity. Especially useful are the hydrogenated liquid oligomers of $C_6$ to $C_{12}$ olefins such as 1-decene trimer. Likewise, alkyl benzenes of proper viscosity, such as didodecyl benzene, can be used. Useful synthetic esters include the esters of monocarboxylic acids and polycarboxylic acids, as well as mono-hydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Blends of mineral oils with synthetic oils are also useful.

Thus, the base oil can be a refined paraffin type base oil, a refined naphthenic base oil, or a synthetic hydrocarbon or non-hydrocarbon oil of lubricating viscosity. The base oil can also be a mixture of mineral and synthetic oils. The most preferred base oil is a Group II; Group III; a mixture of Group II and Group III; a mixture of Group II and synthetic oils; Group IV or mixtures thereof.

Additionally, other additives well known in lubricating oil compositions may be added to the anti-wear additive composition of the present invention to complete a finished oil.

Other Additives

The following additive components are examples of some of the components that can be favorably employed in the present invention. These examples of additives are provided to illustrate the present invention, but they are not intended to limit it:

1. Metal Detergents

Sulfurized or unsulfurized alkyl or alkenyl phenates, alkyl or alkenyl aromatic sulfonates, borated sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof.

2. Anti-Oxidants

Anti-oxidants reduce the tendency of mineral oils to deteriorate in service which deterioration is evidenced by the products of oxidation such as sludge and varnish-like deposits on the metal surfaces and by an increase in viscosity. Examples of anti-oxidants useful in the present invention include, but are not limited to, phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butylidene-bis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-5-methylene-bis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-I-dimethylamino-p-cresol, 2,6-di-tert-4-(N,N'- dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-10-butylbenzyl)-sulfide, and bis(3,5-di-tert-butyl-4-hydroxybenzyl). Diphenylamine-type oxidation inhibitors include, but are not limited to, alkylated diphenylamine, phenyl-alpha-naphthylamine, and alkylated-alpha-naphthylamine. Other types of oxidation inhibitors include metal dithiocarbamate (e.g., zinc dithiocarbamate), and 15-methylenebis(dibutyldithiocarbamate).

3. Anti-Wear Agents
As their name implies, these agents reduce wear of moving metallic parts. Examples of such agents include, but are not limited to, phosphates and thiophosphates and salts thereof, carbamates, esters, and molybdenum complexes.

4. Rust Inhibitors (Anti-Rust Agents)
a) Nonionic polyoxyethylene surface active agents: polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate.
b) Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.

5. Demulsifiers
Addition product of alkylphenol and ethylene oxide, polyoxyethylene alkyl ether, and polyoxyethylene sorbitan ester.

6. Extreme Pressure Anti-Wear Agents (EP/AW Agents)
Sulfurized olefins, zinc dialky-1-dithiophosphate (primary alkyl, secondary alkyl, and aryl type), diphenyl sulfide, methyl trichlorostea rate, chlorinated naphthalene, fluoroalkylpolysiloxane, lead naphthenate, neutralized or partially neutralized phosphates, dithiophosphates, and sulfur-free phosphates.

7. Friction Modifiers
Fatty alcohol, fatty acid (stearic acid, isostearic acid, oleic acid and other fatty acids or salts thereof), amine, borated ester, other esters, phosphates, other phosphites besides tri- and di-hydrocarbyl phosphites, and phosphonates.

8. Multifunctional Additives
Sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound.

9. Viscosity Index Improvers
Polymethacrylate type polymers, ethylene-propylene copolymers, styrene-isoprene copolymers, hydrated styrene-isoprene copolymers, polyisobutylene, and dispersant type viscosity index improvers.

10. Pour Point Depressants
Polymethyl methacrylate.

11. Foam Inhibitors
Alkyl methacrylate polymers and dimethyl silicone polymers.

12. Metal Deactivators
Disalicylidene propylenediamine, triazole derivatives, mercaptobenzothiazoles, thiadiazole derivatives, and mercaptobenzimidazoles.

13. Dispersants
Alkenyl succinimides, alkenyl succinimides modified with other organic compounds, alkenyl succinimides modified by post-treatment with ethylene carbonate or boric acid, esters of polyalcohols and polyisobutenyl succinic anhydride, phenate-salicylates and their post-treated analogs, alkali metal or mixed alkali metal, alkaline earth metal borates, dispersions of hydrated alkali metal borates, dispersions of alkaline-earth metal borates, polyamide ashless dispersants and the like or mixtures of such dispersants.

Method of Making Anti-Wear Additive Composition

The anti-wear additive composition is prepared by mixing at least the following two components at temperatures of from about 50° F. to about 230° F.: (a) at least one acid phosphite compound, such as dihydrocarbyl hydrogen phosphite, such as a dialkyl hydrogen phosphite, such as dilauryl hydrogen phosphite; and (b) at least one neutral phosphite compound, such as trihydrocarbyl phosphite, such as a trialkyl phosphite, such as trilauryl phosphite.

Preferably, the acid phosphite compound is a dialkyl hydrogen phosphite, such as dilauryl hydrogen phosphite, which is commercially available as Duraphos AP-230. Preferably from about 1.0 wt % Duraphos AP-230, which delivers about 0.92 wt % dilauryl hydrogen phosphite, to about 65.0 wt % Duraphos AP-230, which delivers about 59.8 wt % dilauryl hydrogen phosphite, is used in the additive composition.

More preferred from about 1.5 wt % Duraphos AP-230, which delivers about 1.38 wt % dilauryl hydrogen phosphite, to about 60.0 wt % Duraphos AP-230, which delivers about 55.2 wt % dilauryl hydrogen phosphite, is used in the additive composition.

Even more preferred from about 1.7 wt % Duraphos AP-230, which delivers about 1.56 wt % dilauryl hydrogen phosphite, to about 35.0 wt % Duraphos AP-230, which delivers about 32.2 wt % dilauryl hydrogen phosphite, is used in the additive composition.

Most preferred from about 2.5 wt % Duraphos AP-230, which delivers about 2.3 wt % dilauryl hydrogen phosphite, to about 20.0 wt % Duraphos AP-230, which delivers about 18.4 wt % dilauryl hydrogen phosphite, is used in the additive composition.

Preferably, the neutral phosphite compound is a trialkyl phosphite, such as trilauryl phosphite, which is commercially available as Duraphos TLP. Preferably from about 35.0 wt % Duraphos TLP, which delivers about 2.625 wt % of dilauryl hydrogen phosphite and about 31.5 wt % trilauryl phosphite, to about 99.0 wt % Duraphos TLP, which delivers about 7.43 wt % dilauryl hydrogen phosphite and about 89.1 wt % trilauryl phosphite, is used in the additive composition.

More preferred from about 40.0 wt % Duraphos TLP, which delivers about 3.0 wt % of dilauryl hydrogen phosphite and about 36.0 wt % trilauryl phosphite, to about 98.5 wt % Duraphos TLP, which delivers about 7.39 wt % dilauryl hydrogen phosphite and about 88.65 wt % trilauryl phosphite, is used in the additive composition.

Even more preferred from about 65.0 wt % Duraphos TLP, which delivers about 4.88 wt % of dilauryl hydrogen phosphite and about 58.5 wt % trilauryl phosphite, to about 98.3 wt % Duraphos TLP, which delivers about 7.37 wt % dilauryl hydrogen phosphite and about 88.47 wt % trilauryl phosphite, is used in the additive composition.

Most preferred from about 80.0 wt % Duraphos TLP, which delivers about 6.0 wt % of dilauryl hydrogen phosphite and about 72.0 wt % trilauryl phosphite, to about 97.5 wt % Duraphos TLP, which delivers about 7.31 wt % dilauryl hydrogen phosphite and about 87.75 wt % trilauryl phosphite, is used in the additive composition.

A preferred weight ratio of at least one acid phosphite compound to at least one neutral phosphite compound is from about 1.0:10.7 to about 2.0:1.0. More preferred, the ratio of at least one acid phosphite compound to at least one neutral phosphite compound is from about 1.0:10.1 to about 1.6:1.0. Even more preferred, the ratio of at least one acid phosphite compound to at least one neutral compound is from about 1.0:9.9 to about 1.0:1.6. Most preferred, the ratio of at least one acid phosphite compound to at least one neutral phosphite compound is from about 1.0:9.1 to about 1.0:3.0.

Method of Making Lubricating Oil Composition

Other additives, including but not limited to, dispersants, detergents, oxidation inhibitors, seal swell agents, and foam inhibitors may be added to the anti-wear additive composition, described herein, effectively making an automatic transmission fluid (ATF) additive package. This ATF additive package may be added to an oil of lubricating viscosity forming a lubricating oil composition, which is also referred to as a finished lubricating oil composition. Preferably, this ATF additive package may be added in an amount which delivers from about 0.045 wt % to about 5.66 wt % of the anti-wear additive composition. More preferred, this ATF additive package may be added in an amount which delivers from about 0.09 wt % to about 4.72 wt % of the anti-wear additive composition. Most preferred, this ATF additive package may be added in an amount which delivers from about 0.18 wt % to about 1.89 wt % of the anti-wear additive composition. This lubricating oil composition is made by mixing the anti-wear additive composition, the remaining optional components of the ATF additive composition and an oil of lubricating viscosity in a stainless steel vessel at a temperature of from about 75 degrees F. to about 180 degrees F. from about 1 to about 6 hours.

Optionally this anti-wear additive composition also can be used as a top treat to a finished lubricating oil composition.

Furthermore, if the oil of lubricating viscosity already comprises either the acid phosphite compound or the neutral phosphite compound, then the other phosphite compound, either the acid phosphite or the neutral phosphite, that is absent from the finished oil may be added. The amount of the added acid phosphite compound or the neutral phosphite compound should not exceed 0.3 wt % total phosphorous in the finished oil. A preferred amount of phosphorous present in the finished oil is from about 0.003 wt % to about 0.3 wt %. A more preferred amount of phosphorous present in the finished oil is from about 0.006 wt % to about 0.25 wt %. A most preferred amount of phosphorous present in the finished oil is from about 0.012 wt % to about 0.1 wt %.

Method of Use of the Present Invention

The present invention is used to decrease the wear of the metal of at least two mating metal surfaces in relative motion. Specifically, the lubricating oil of the present invention contacts metal components in axles, pumps and transmissions to reduce wear and lubricates contiguous metal components thereby decreasing wear of the mating metal surfaces. The lubricating oil composition of the present invention typically contains from about 0.045 wt % to about 5.66 wt % of the anti-wear additive composition of the present invention. Preferably, the lubricating oil of the present invention contains from about 0.09 wt % to about 4.72 wt % of the anti-wear additive composition of the present invention. Most preferred, the lubricating oil of the present invention contains from about 0.18 wt % to about 1.89 wt % of the anti-wear additive composition of the present invention. The anti-wear additive composition will optionally contain sufficient inorganic liquid diluent to make it easy to handle during shipping and storage. Typically, the anti-wear additive composition will contain from about 1% to about 40% of the organic liquid diluent and preferably from about 3% to about 20 wt %. Suitable organic diluents which can be used include, for example, solvent refined 100N (i.e., Cit-con 100N which may be purchased from Citgo Petroleum Corporation, Houston, Tex.), and hydrotreated 100N (i.e., Chevron 100N which may be purchased from ChevronTexaco Corporation, San Ramon, Calif.), and the like. The organic diluent preferably has a viscosity of about 10 to 20 cSt at 100° C.

Performance Testing

The anti-wear additive composition of the present invention was tested for wear using a modified version of ASTM D-2882 Test Method, which was developed to measure the weight loss of metal as it relates to erosion caused by wear. The standard test for lubrication and pump wear properties is ASTM D-2882 which employs a similar method as described herein. The differences between the standard and the modified versions involve operating at different pressures (2,000 psi, standard, and 1,000 psi, modified) and the allowable maximum amount of weight loss to be considered an excellent anti-wear hydraulic fluid (twenty milligrams, standard, and ten milligrams, modified). In the modified test, the hydraulic fluid is circulated through a Vickers pump and a pressure relief valve at 1,000 psi and 175° F. for 100 hours. The ring and vane components of the pump are weighed before and after the test to determine the total weight loss. Less weight loss indicates better lubrication and better wear inhibition. Using the DEXRON®-III automatic transmission fluid (ATF) specification, the maximum allowable weight loss is 10 mg. Typically, the anti-wear additive composition of the present invention meets the wear requirements of the DEXRON®-III automatic transmission fluid (ATF) specification using the modified ASTM D-2882 test. The DEXRON®-III specification (DEXRON®-III, H Revision, Automatic Transmission Fluid Specification, GMN10055) may be purchased from IHS Engineering, Inc. at http://www.global.ihs.com.

In some cases, the anti-wear additive composition was also tested for its effects with regard to copper corrosion. It was evaluated according to the ASTM D-130 test procedure (121° C. for 3 hours). The ASTM D-130 Test Method is the test that was developed to measure the stability of the lubricating oil in the presence of copper and copper alloys (i.e., extent of copper corrosion). In addition to the ASTM D-130 rating (copper corrosion is measured on a scale of 1 to 4, wherein a result of 1 represents slight tarnish and a result of 4 represents copper corrosion), inductively coupled plasma (ICP) measurement in the used oil was also conducted. The anti-wear additive composition of the present invention results in copper corrosion of less than 20 ppm of copper in the used oil as measured by ICP and in the ASTM D-130 test. Using solely dilauryl hydrogen phosphite as an anti-wear additive in a lubricating oil composition increases the amount of copper corrosion (see Comparative Example E).

The following examples are presented to illustrate specific embodiments of this invention and are not to be construed in any way as limiting the scope of the invention.

EXAMPLES

Base Blend Example

An automatic transmission additive package was prepared by mixing the following components at about 195 degrees F for about two hours: 53.88 wt % 1000 MW monosuccinimide dispersant, 12.74 wt % 1300 MW bissuccinimide dispersant post-treated with boric acid, 0.28 wt % high overbased (HOB) calcium sulfonate, 3.82 wt % phenolic oxidation inhibitor, 6.37 wt % aminic oxidation inhibitor, 0.51 wt % triazole derivative, 6.37 wt % benzoate ester seal swell agent, 1.27 wt % foam inhibitor, 2.55 wt % polyamide of tetraethylpentaamine (TEPA) and isostearic acid (ISA), 7.20 wt % Duraphos TLP, and 5.01 wt % Group I 100 N diluent oil.

Fifty five gallons of automatic transmission fluid (ATF) were prepared by blending 7.85 wt % of the above defined additive package, 2.50 wt % polyalkyl methacrylate (PMA)-dispersant viscosity index improver (the weighted-average molecular weight of the polymer is approximately 350,000), 79.63 wt % Group II 100 N base oil, and 10.02 wt % polyalphaolefin 4 cSt. These components were blended in a stainless steel vessel at a temperature of between about 125 degrees F to about 140 degrees F for about 2 hours. The finished, blended oil had a viscosity of approximately 6.9 cSt at 100 C. The finished, blended oil contained about 0.565 wt % Duraphos TLP with a total phosphorous content of about 300 ppm. The ratio of dilauryl hydrogen phosphite to trilauryl phosphite in the finished oil was 1.0:12.0.

Example 1

Four gallons of automatic transmission fluid blend from the Base Blend Example above were prepared by mixing in a stainless steel vessel 0.08 wt % Duraphos AP-230, a dilauryl hydrogen phosphite, 0.04 wt % of a thiadiazole derivative (Hitec 4313) to 99.88 wt % of the above described base blend. These components were blended at about 120 degrees F for about 1 hour. This finished oil contained about 0.565 wt % of Duraphos TLP, which delivers about 0.04 wt % dilauryl hydrogen phosphite and about 0.509 wt % trilauryl phosphite, and about 0.08 wt % Duraphos AP-230, which delivers about 0.074 wt % dilauryl hydrogen phosphite, with a total phosphorous content of about 359 ppm in the finished oil. The ratio of dilauryl hydrogen phosphite to trilauryl phosphite in the finished oil was 1.0:4.2.

The finished oil was evaluated for wear inhibition using the modified ASTM D2882 wear test. The results of the test indicated a weight loss of 5.8 mg, which is a passing result according to the GM wear specification.

Example 2

An automatic transmission additive package was prepared by mixing the following components at 145 degrees F for about two hours: 51.97 wt % 1000 MW monosuccinimide dispersant, 12.28 wt % 1300 MW bissuccinimide dispersant post-treated with boric acid, 3.98 wt % high overbased calcium sulfonate, 3.69 wt % phenolic oxidation inhibitor, 6.14 wt % aminic oxidation inhibitor, 0.98 wt % thiadiazole derivative, 6.14 wt % benzoate ester seal swell agent, 1.23 wt % foam inhibitor, 0.42 wt % oleylamide, 0.21 wt % glycerol monooleate, 0.98 wt % Duraphos AP-230, 6.94 wt % Durpahos TLP and 5.04 wt % Group I 100 N diluent oil.

110 gallons of automatic transmission fluid were prepared by blending 8.14 wt % of the above described additive package with 200 ppm red dye, 2.65 wt % polyalkyl methacrylate (PMA)-dispersant viscosity index improver (the weighted-average molecular weight of the polymer is approximately 350,000), 79.19 wt % Group II 100N base oil, and 10.0 wt % PAO cST. The components were blended in a stainless steel vessel at a temperature of between about 125 F to about 140 F for about 2 hours. The finished, blended oil had a viscosity of approximately 7.1 cSt at 100 C. This finished oil contained about 0.565 wt % of Duraphos TLP, which delivers about 0.04 wt % dilauryl hydrogen phosphite and about 0.509 wt % trilauryl phosphite, and about 0.08 wt % Duraphos AP-230, which delivers about 0.074 wt % dilauryl hydrogen phosphite, with a total phosphorous content of about 359 ppm in the finished oil. The ratio of dilauryl hydrogen phosphite to trilauryl phosphite in the finished oil was 1.0:4.2.

The finished oil was evaluated for wear inhibition using the modified ASTM D2882 wear test. The results of the test indicated a weight loss of 0.6 mg, which is a passing result according to the GM wear specification.

Example 3

An automatic transmission additive package was prepared by mixing the following components at 145 degrees F for about two hours: 45.93 wt % 1000 MW monosuccinimide dispersant, 13.12 wt % 1300 MW bissuccinimide dispersant post-treated with boric acid, 4.25 wt % high overbased calcium sulfonate, 3.94 wt % phenolic oxidation inhibitor, 6.56 wt % aminic oxidation inhibitor, 1.31 wt % thiadiazole derivative, 9.84 wt % benzoate ester seal swell agent, 0.66 wt % primary aliphatic amine, 1.31 wt % foam inhibitor, 0.45 wt % oleylamide, 0.22 wt % glycerol monooelate, 7.41 wt % Duraphos TLP and 5.0 wt % Group I 100N diluent oil.

Ten gallons of a finished oil automatic transmission fluid were prepared by blending 7.62 wt % of the above described additive package with 0.02 wt % Duraphos AP-230, 3.2 wt % polyalkyl methacrylate (PMA)-dispersant viscosity index improver (the weighted-average molecular weight of the polymer is approximately 350,000), 79.16 wt % Group II 100N base oil and 10.0 wt % PAO 4 cST. These components were blended in a stainless steel vessel at a temperature of about 125 degrees F. to about 140 degrees F. for about 2 hours. The finished, blended oil contained about 0.565 wt % of Duraphos TLP, which delivers about 0.04 wt % dilauryl hydrogen phosphite and about 0.509 wt % trilauryl phosphite, and about 0.02 wt % Duraphos AP-230, which delivers 0.018 wt % dilauryl hydrogen phosphite, with a total phosphorous content of about 315 ppm. The ratio of dilauryl hydrogen phosphite to trilauryl phosphite in the finished oil was 1.0:8.5.

The finished oil was evaluated for wear inhibition using the modified ASTM D2882 wear test. The results of the test indicated a weight loss of 2.4 mg, which is a passing result according to the GM wear specification.

Example 4

An anti-wear additive package was prepared by adding 0.565 wt % of trilauryl phosphite, Duraphos TLP, and 0.02 wt % of Duraphos AP-230 to approximately 200 grams of a base oil composition comprised of a base oil blend comprised of about 87.3% RLOP 100 N (which may be purchased from ChevronTexaco Corporation, San Ramon, Calif.) and about 12.7% Citgo Bright Stock (which may be purchased from Citgo Petroleum Corporation, Tulsa, Okla.) to a stainless steel vessel. A ratio of dilauryl hydrogen phosphite to trilauryl phosphite was calculated at 1:8.34 with 314 ppm of phosphorous in the finished oil.

Example 5

An anti-wear additive package was prepared by adding 0.565 wt % of trilauryl phosphite, Duraphos TLP, and 0.08 wt % of Duraphos AP-230 to approximately 200 grams of a base oil composition comprised of a base oil blend comprised of about 87.3 RLOP 100 N (which may be purchased from ChevronTexaco Corporation, San Ramon, Calif.) and about 12.7% Citgo Bright Stock (which may be purchased from Citgo Petroleum Corporation, Tulsa, Okla.) to a stainless steel vessel. A ratio of dilauryl hydrogen phosphite to trilauryl phosphite was calculated at 1:4.38 with 359 ppm of phosphorous in the finished oil.

Example 6

An anti-wear additive package was prepared by adding 0.63 wt % of trilauryl phosphite, Duraphos TLP, and 0.42 wt % of Duraphos AP-230 to approximately 400 grams of a base oil composition comprised of a base oil blend comprised of about 87.3 RLOP 100 N (which may be purchased from ChevronTexaco Corporation, San Ramon, Calif.) and about 12.7% Citgo Bright Stock (which may be purchased from Citgo Petroleum Corporation, Tulsa, Okla.) to a stainless steel vessel. A ratio of dilauryl hydrogen phosphite to trilauryl phosphite was calculated at 1:1.31 with 645 ppm of phosphorous in the finished oil.

Example 7

An anti-wear additive package was prepared by adding 0.50 wt % of trilauryl phosphite, Duraphos TLP, and 0.51 wt % of Duraphos AP-230 to approximately 400 grams of a base oil composition comprised of a base oil blend comprised of about 87.3 RLOP 100 N (which may be purchased from ChevronTexaco Corporation, San Ramon, Calif.) and about 12.7% Citgo Bright Stock (which may be purchased from Citgo Petroleum Corporation, Tulsa, Okla.) to a stainless steel vessel. A ratio of dilauryl hydrogen phosphite to trilauryl phosphite was calculated at 1:0.89 with 642 ppm of phosphorous in the finished oil.

Example 8

An anti-wear additive package was prepared by adding 0.40 wt % of trilauryl phosphite, Duraphos TLP, and 0.59 wt % of Duraphos AP-230 to approximately 400 grams of a base oil composition comprised of a base oil blend comprised of about 87.3 RLOP 100 N (which may be purchased from ChevronTexaco Corporation, San Ramon, Calif.) and about 12.7% Citgo Bright Stock (which may be purchased from Citgo Petroleum Corporation, Tulsa, Okla.) to a stainless steel vessel. A ratio of dilauryl hydrogen phosphite to trilauryl phosphite was calculated at 1:0.63 with 649 ppm of phosphorous in the finished oil.

Comparative Examples

Comparative Example A

An automatic transmission additive package was prepared by mixing the following components at about 195 degrees F for about two hours: 53.88 wt % 1000 MW monosuccinimide dispersant, 12.74 wt % 1300 MW bissuccinimide dispersant post-treated with boric acid, 0.28 wt % high overbased calcium sulfonate, 3.82 wt % phenolic oxidation inhibitor, 6.37 wt % aminic oxidation inhibitor, 0.51 wt % triazole derivative, 6.37 benzoate ester seal swell agent, 1.27 wt % foam inhibitor, 2.55 wt % polyamide of TEPA and ISA, 7.20 wt % Durpahos TLP and 5.01 wt % Group I 100 N diluent oil.

About 17 gallons of automatic transmission fluid were prepared by blending 7.85 wt % of this additive package, 2.60 wt % polyalkyl methacrylate (PMA)-dispersant viscosity index improver (the weighted average molecular weight of the polymer is approximately 350,000), 79.55 wt % Group II 100 N base oil, and 10.0 wt % PAO 4 cSt. The components were blended in a stainless steel vessel at a temperature of between about 125 degrees F. to about 140 degrees F. for about 2 hours. The finished, blended oil had a viscosity of approximately 7.0 cSt at 100 degrees C. The finished, blended oil contained about 0.565 wt % Duraphos TLP, which delivers 0.04 wt % dilauryl hydrogen phosphite and 0.509 wt % trilauryl phosphite, with a total phosphorous content of about 300 ppm. The ratio of dilauryl hydrogen phosphite to trilauryl phosphite in the finished oil was 1.0:12.0.

Using the modified ASTM D2882 wear test, the results of this finished oil were failing with a weight loss of 13.9 mg.

Comparative Example B

Four gallons of ATF from Comparative Example A were prepared by mixing in a stainless steel vessel 0.11 wt % Duraphos TLP, 0.04 wt % of a thiadiazole derivative (Hitec 4313) to 99.85 wt % of the above described Base Blend Example; these components were blended at about 120 degrees F. for about 1 hour. The finished oil contained about 0.675 wt % of Duraphos TLP, which delivers 0.051 wt % dilauryl hydrogen phosphite and 0.608 wt % trilauryl phosphite, with a total phosphorous content of 358 ppm in the finished oil. The ratio of dilauryl hydrogen phosphite to trilauryl phosphite in the finished oil was 1.0:12.0.

Using the modified ASTM D2882 wear test, the results of the finished oil were failing with a weight loss of 14.2.

Comparative Example C

An anti-wear additive package was prepared by adding 0.29 wt % of trilauryl phosphite, Duraphos TLP, and 0.67 wt % of Duraphos AP-230 to approximately 400 grams of a base oil composition comprised of a base oil blend comprised of about 87.3 wt % RLOP 100 N (which may be purchased from ChevronTexaco Corporation, San Ramon, Calif.) and about 12.7 wt % Citgo Bright Stock (which may be purchased from Citgo Petroleum Corporation, Tulsa, Okla.) to a stainless steel vessel. A ratio of dilauryl hydrogen phosphite to trilauryl phosphite was calculated at 1:0.41 with 650 ppm of phosphorous in the finished oil.

Comparative Example D

An anti-wear additive package was prepared by adding 0.19 wt % of trilauryl phosphite, Duraphos TLP, and 0.74 wt % of Duraphos AP-230 to approximately 400 grams of a base oil composition comprised of a base oil blend comprised of about 87.3 RLOP 100 N (which may be purchased from ChevronTexaco Corporation, San Ramon, Calf.) and about 12.7% Citgo Bright Stock (which may be purchased from Citgo Petroleum Corporation, Tulsa, Okla.) to a stainless steel vessel. A ratio of dilauryl hydrogen phosphite to trilauryl phosphite was calculated at 1:0.25 with 648 ppm of phosphorous in the finished oil.

Comparative Example E

An anti-wear additive package was prepared by adding 0.88 wt % of Duraphos AP-230 to approximately 1000 grams of a base oil composition comprised of a base oil blend comprised of about 87.3 wt % RLOP 100 N (which may be purchased from ChevronTexaco Corporation, San Ramon, Calif.) and about 12.7% Citgo Bright Stock (which may be purchased from Citgo Petroleum Corporation, Tulsa, Okla.) to a stainless steel vessel. A ratio of dilauryl hydrogen phosphite to trilauryl phosphite was calculated at 1:0.00 (i.e. no trilauryl phosphite is present) with 651 ppm of phosphorous in the finished oil.

Comparative Example F

An anti-wear additive package was prepared by adding 1.32 wt % of trilauryl phosphite, Duraphos TLP, to approximately 6800 grams of a base oil composition comprised of about 87.3% RLOP 100 N (which may be purchased from ChevronTexaco Corporation, San Ramon, Calif.) and about 12.7% Citgo Bright Stock (which may be purchased from Citgo Petroleum Corporation, Tulsa, Okla.) to a stainless steel vessel. The components were blended for approximately two hrs at a temperature of from about 120 F to about 140 F. A ratio of dilauryl hydrogen phosphite to trilauryl phosphite was calculated at 1.0:12.0 with 700 ppm of phosphorous in the finished oil.

Performance Results

Example 1

The composition of this example was evaluated for weight loss according to ASTM D-2882. The weight loss according to modified ASTM D-2882 is 2.4 mg.

Example 2

The finished oil was evaluated for wear inhibition using the modified ASTM D2882 wear test. The results of the test indicated a weight loss of 0.6 mg, which is a passing result according to the GM wear specification.

Example 3

The finished oil was evaluated for wear inhibition using the modified ASTM D2882 wear test. The results of the test indicated a weight loss of 2.4 mg, which is a passing result according to the GM wear specification.

Example 4

The composition of this example was evaluated for copper corrosion. The ASTM D130 test resulted in a 1b rating with a concentration of 4 ppm of copper in the used oil.

Example 5

The composition of this example was evaluated for copper corrosion. The ASTM D130 test resulted in a 1b rating with a concentration of 4 ppm of copper in the used oil.

Example 6

The composition of this example was evaluated for copper corrosion. The ASTM D130 test resulted in a 1a rating with a concentration of 8 ppm of copper in the used oil.

Example 7

The composition of this example was evaluated for copper corrosion. The ASTM D130 test resulted in a 1a rating with a concentration of 10 ppm of copper in the used oil.

Example 8

The composition of this example was evaluated for copper corrosion. The ASTM D130 test resulted in a 1a rating with a concentration of 14 ppm of copper in the used oil.

Comparative Examples

Comparative Example A

The composition of this example was evaluated for weight loss according to ASTM D-2882. The weight loss according to modified ASTM D-2882 is 13.9 mg and does not pass the GM wear specification.

Comparative Example B

The composition of this example was evaluated for weight loss according to ASTM D-2882. The weight loss according to modified ASTM D-2882 is 14.3 mg and does not pass the GM wear specification.

Comparative Example C

The composition of this example was evaluated for copper corrosion. The ASTM D130 test resulted in a 1b rating with a concentration of 20 ppm of copper in the used oil.

Comparative Example D

The composition of this example was evaluated for copper corrosion. The ASTM D130 test resulted in a 1b rating with a concentration of 23 ppm of copper in the used oil.

Comparative Example E

The composition of this example was evaluated for copper corrosion. The ASTM D130 test resulted in a 1a rating with a concentration of 26 ppm of copper in the used oil.

Comparative Example F

The composition of this example was evaluated for copper corrosion. The ASTM D130 test resulted in a 1b rating with a concentration of 4 ppm of copper in the used oil. About twice as much of the Duraphos TLP compared to Comparative Example A was used to obtain this copper value. However, Comparative Example B shows that increasing the level of Duraphos TLP compared to Comparative Example A does not significantly improve the anti-wear properties, as both Comparative Examples A and B failed the wear test with similar weight loss. Accordingly, Comparative Example F would be expected to fail the wear test as well.

It is understood that although modifications and variations of the invention can be made without departing from the spirit and scope thereof, only such limitations should be imposed as are indicated in the appended claims.

What is claimed is:

1. A lubricating oil composition comprising:

(a) at least one dilauryl hydrogen phosphite compound;

(b) at least one trilauryl phosphite compound;

(c) an oil of lubricating viscosity; and wherein the weight ratio of (a) to (b) is from about 1.0:8.5 to about 1.6:1.0 wherein the amount of phosphorus in the lubricating oil composition is from about 0.012 wt % to about 0.1 wt %.

2. The lubricating oil composition according to claim 1, wherein the ratio of (a) to (b) is from about 1.0:8.5 to about 1.0:0.63.

3. The lubricating oil composition according to claim 2, wherein the ratio of (a) to (b) is from about 1.0:8.5 to about 1.0:1.6.

4. The lubricating oil composition according to claim 3, wherein the ratio of (a) to (b) is from about 1.0:8.5 to about 1.0:3.0.

5. A method of reducing wear of metal components comprising lubricating contiguous metal components with the lubricating oil composition of claim 1.

* * * * *